US006490793B1

(12) United States Patent
Maderud et al.

(10) Patent No.: US 6,490,793 B1
(45) Date of Patent: Dec. 10, 2002

(54) METHOD OF MANUFACTURE OF AS-CAST COMPOSITE ROLL

(75) Inventors: Carl-Johan Maderud, Stockholm (SE); Jan-Erik Karlsson, Tyresö (SE)

(73) Assignee: Sandvik AB (SE)

( * ) Notice: Subject to any disclaimer, the term of this patent is extended or adjusted under 35 U.S.C. 154(b) by 0 days.

(21) Appl. No.: 09/556,323

(22) Filed: Apr. 24, 2000

Related U.S. Application Data

(62) Division of application No. 09/245,124, filed on Jan. 14, 1999, now Pat. No. 6,095,958, which is a continuation of application No. 08/675,677, filed on Jul. 3, 1996, now abandoned.

(30) Foreign Application Priority Data

Jul. 3, 1996 (SE) ..... 9502639

(51) Int. Cl.[7] ..... B21K 1/02
(52) U.S. Cl. ..... 29/895.21; 492/58
(58) Field of Search ..... 492/38, 39, 54, 492/53, 58; 29/895.21; 148/321, 35, 529, 589, 324; 75/242, 243, 241, 240; 164/91

(56) References Cited

U.S. PATENT DOCUMENTS 3,609,849 A 10/1971 Krol ..... 29/132
4,119,459 A * 10/1978 Ekemar et al. ..... 75/243
4,396,442 A 8/1983 Nakamura et al. ..... 148/138
5,044,056 A 9/1991 Sundstedt et al. ..... 29/132
5,104,458 A 4/1992 Sundstedt et al. ..... 148/3
5,167,067 A 12/1992 Sundstedt et al. ..... 29/895.21
5,248,289 A 9/1993 Carlsson et al. ..... 492/39
5,359,772 A 11/1994 Carlsson et al. ..... 29/895.32

FOREIGN PATENT DOCUMENTS

EP 0374116 6/1990
EP 0464780 1/1992

OTHER PUBLICATIONS

"5 Cast Irons" edited by R.K. Buhr, condensed from Metals Handbook, Nith Edition, vol. 1, Properties and Selection: Irons and Steels, pp. 5–1 through 5–20.
"28 Heat Treating" edited by Ross B. Shingledecker, condensed from Metals Handbook, Ninth Edition, vol. 4, Heat Treating, pp. 28–1 through 28–10.

* cited by examiner

*Primary Examiner*—David P. Bryant
(74) *Attorney, Agent, or Firm*—Burns, Doane, Swecker & Mathis, LLP

(57) ABSTRACT

A method of manufacturing an as-cast composite roll by metallurgically bonding one or more rings of cemented carbide to a cast iron casing. The composite roll may be used for hot or cold rolling. The cast iron has the following composition in addition to Fe, in weight %, 1.9–2.8% Si, 0.02–0.10% Mg, 0.5–4% Ni, 0.1–1% Mn, balance Fe and a $C_{eqv}$=2.5–6.

9 Claims, 3 Drawing Sheets

METHOD OF MANUFACTURE OF AS-CAST COMPOSITE ROLL

This application is a divisional of application Ser. No. 09/245,124, filed Jan. 14, 1999 now U.S. Pat. No. 6,095,958 which is a continuation of application Ser. No. 08/675,677, filed Jul. 3, 1996, now abandoned.

FIELD OF THE INVENTION

The present invention relates to a composite roll including at least one cemented carbide ring and nodular cast iron casing. The composite roll can be available as a complete roll or as a roll ring to be attached to a driving spindle.

BACKGROUND OF THE INVENTION

Composite rolls with cemented carbide for hot or cold rolling comprise one or more cemented carbide rings with a casing of cast iron attached to a (driving) spindle by various couplings and locking devices. One problem with such rolls is that during cooling from the casting temperature the casing shrinks more than the cemented carbide ring. As a result, inwardly directed forces on the cemented carbide ring are produced, giving rise to axially directed tensile stresses on the outer surface of the cemented carbide ring, which are acting perpendicularly to microcracks generated in the roll surface during rolling. Under the influence of these tensile stresses the microcracks propagate in depth, which may cause roll breakage or need for an excessive amount of dressing, limiting the total rolling capacity of the roll.

One solution to this problem is described in U.S. Pat. No. 5,044,056, according to which one or more cemented carbide rings are cast into a casing of an essentially graphitic cast iron having bainite and preferably 15–20 weight % residual austenite, which during one or more subsequent heat treatment steps totally or partly is transformed to bainite. In this way, a favorable stress state is obtained. However, this heat treatment is a costly and time consuming operation which would be desirable to eliminate. Swedish Patent Application No. 9100405-1 corresponding to U.S. Pat. Nos. 5,248,289 and 5,359,772, discloses that even a complete roll can be made in the same way with maintained good bond between the cast iron and the cemented carbide. However, heat treatment of complete rolls with a length of up to 2500 mm requires furnaces with large dimensions and long cycle heat treatments which increases the door to door time. The resulting structure with a mix of bainite and residual austenite is also very difficult to machine.

SUMMARY OF THE INVENTION

The present invention seeks to overcome disadvantages and drawbacks of the prior art composite rolls.

According to the present invention it has been found that by using an alloy giving an as-cast material with a structure of pearlite and ferrite, the desired state of stress is provided in combination with a good metallurgical bond without subsequent heat treatment of the roll. The cast iron is easily machined in an as-cast condition and has a hardness-toughness-strength which is well balanced during use of the roll.

BRIEF DESCRIPTION OF THE DRAWINGS

The invention will be described in greater detail with reference to the accompanying drawings in which like elements bear like reference numerals, and wherein.

DETAILED DESCRIPTION OF THE PREFERRED EMBODIMENTS

According to the present invention, cemented carbide is metallurgically bonded to an essentially graphitic cast iron. The cast iron has a composition adjusted so that the carbon equivalent, expressed in weight percent, $C_{eqv}$=% C+0.3.(% Si+% P) is 2.5–6, preferably 3.5–5. Ferro-silicium-magnesium and/or nickel-magnesium is/are added to the cast alloy to provide a magnesium content of 0.02–0.10 wt %, preferably 0.04–0.07 wt %. By inoculation with ferro-silicium the cast iron obtains a silicon content of 1.9–2.8 wt %, preferably 2.1–2.5 wt %. Thereby, a nodular cast iron is obtained having dispersed, spheroidal graphite. Further, the cast iron is preferably alloyed with elements delaying the diffusion of carbon, preferably nickel in an amount of 0.5–4, preferably 1–2 wt %, and manganese in an amount of 0.1–1.0, preferably 0.6–0.7 wt %, resulting in a structure of pearlite and ferrite with not less than 40 volume % pearlite and some amount <5 volume % of residual austenite. Ni and/or Cu may partly be replaced by up to 1 wt % Mo. For a weight of the cast iron portion of the roll in excess of 1000 kg, an addition of <2 wt %, preferably 0.01–1 wt % Cu, is suitable. In the as-cast condition, the cast iron in the roll has a Brinell hardness of 190–250 for a weight between 200 and 1000 kg of the cast iron portion of the roll.

In one embodiment, the roll is a complete roll including roll core and journals with at least one cemented carbide ring. Roll core and journals may be made of another cast alloy.

Figure 1:
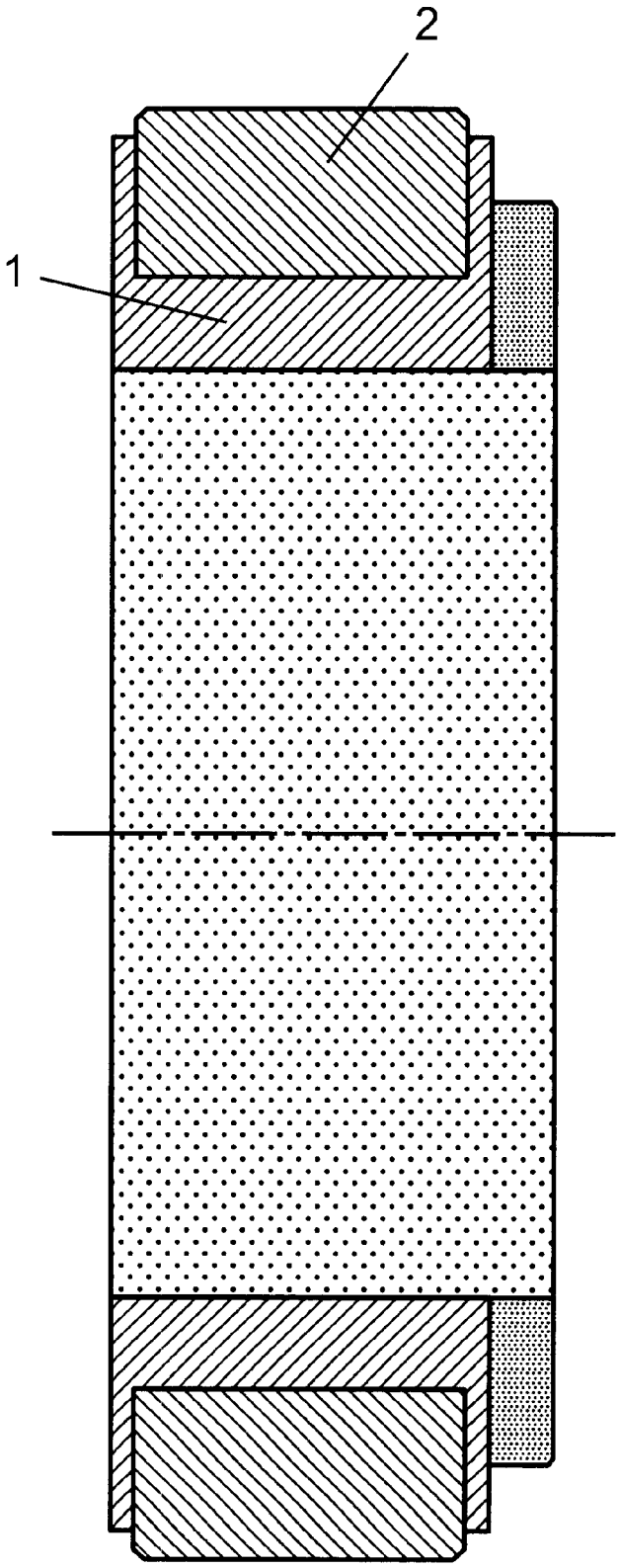
FIG. 1 shows a composite roll consisting of a cemented carbide ring 2 and cast iron casing 1 to. be mounted on a spindle.
Figure 2:
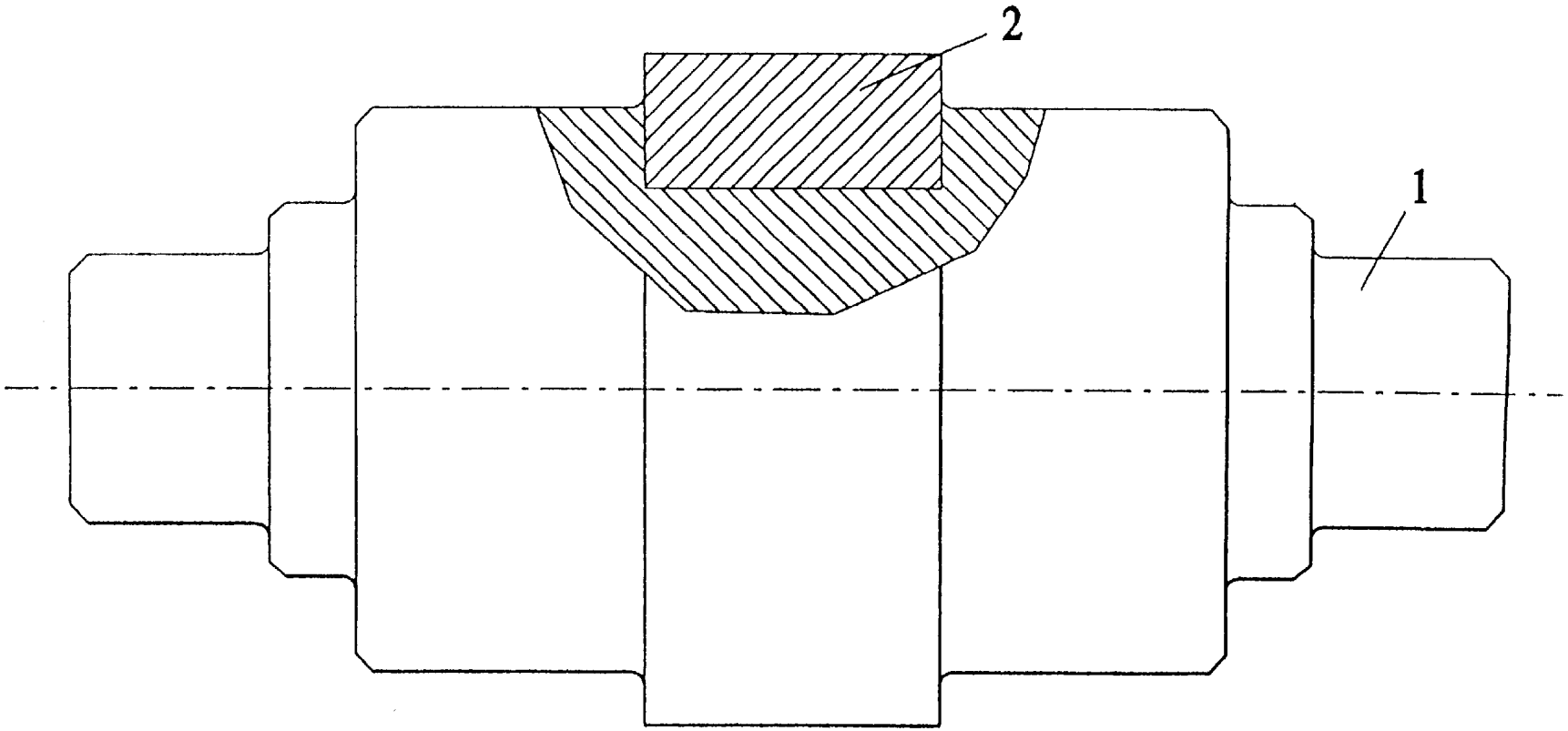
FIG. 2 shows a complete roll including roll core and journals 11 with one cast-in cemented carbide ring 2.
Figure 3:
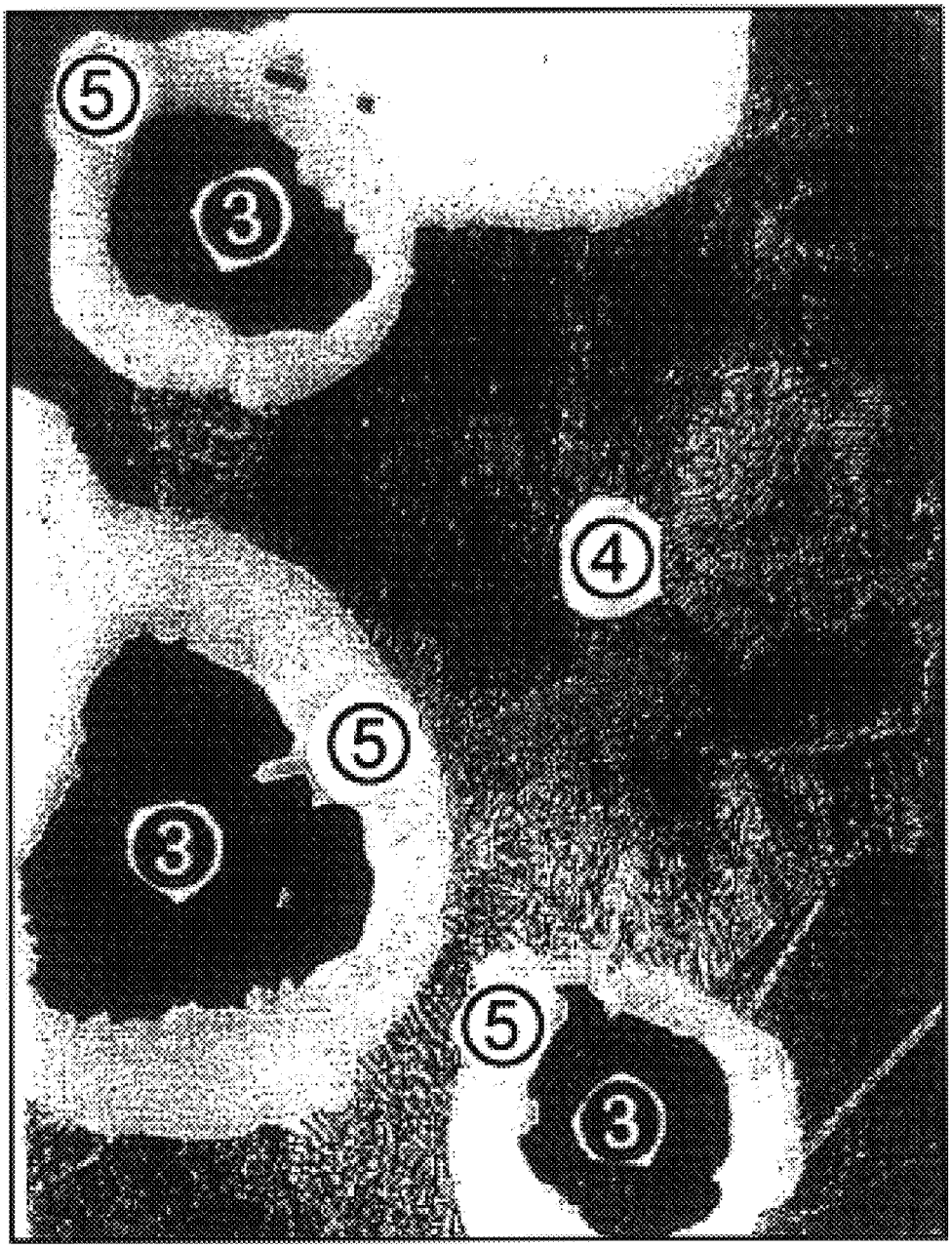
FIG. 3 shows the microstructure of the nodular cast iron according to the invention including graphite nodules 3, pearlite 4, and ferrite 5.

In another alternative embodiment, the roll comprises a cemented carbide ring (or rings) cast into a ring-shaped casing only which rings are attached to a (driving) spindle by various couplings and locking devices. For instance, FIG. 1 shows a composite roll consisting of a cemented carbide ring 2 and cast iron casing 1 to be mounted on a spindle whereas FIG. 2 shows a complete roll including roll core and journals 1 with one cast-in cemented carbide ring 2. As shown in FIG. 3, the microstructure of the nodular cast iron of the roll includes graphite nodules 3, pearlite 4, and ferrite 5.

According to the invention there is also provided a method for manufacture of a complete roll including roll core and journals or cemented carbide ring(s) cast into a ring-shaped casing only which ring(s) are attached to a spindle for hot or cold rolling. According to the method at least one sintered cemented carbide ring is placed in a mould with the inner surface of the ring and its side surfaces free to establish contact with the cast iron. The mould is filled with molten cast iron with the composition according to the invention and maintained at a suitable temperature. After cooling to room temperature the roll is cleaned and machined to final shape and dimension.

In one embodiment, the casting is made by the static method. In a preferred embodiment, the roll is cast by static casting in a mould where the inlet is directed in a tangential direction to the inner surface of the cemented carbide roll ring.

In another embodiment, the casting is made by centrifugal casting wherein the mould is rotated and when a suitable speed, e.g., about 400 rev/min, is achieved the molten cast iron is poured into the rotating mould. The rotating speed is continuously decreased during the pouring time which lasts about 1 min. As a result, the molten iron is slung against the wall of the mould and solidifies under pressure. Alternatively, the cemented carbide ring (or rings) is cast into a casing of only cast iron according to the invention, after which core and journals are cast of another cast alloy either by centrifugal or static casting.

In order to achieve optimum metallurgical bonding between cemented carbide and cast iron it is necessary to use an over-temperature of 200–300° C. of the iron in the ladle, e.g., the molten cast iron is heated above 1500 to 1600° C. In addition, casting can be carried out with a controlled rate of filling of the mould. In the case of centrifugal casting, it is desirable to utilize a predetermined speed of rotation to get a balanced heating and melting of a surface layer of the part of the cemented carbide ring which is not moulded in the foundry sand, i.e. the part that shall be metallurgically bonded to the cast iron. A transition zone between cemented carbide and cast iron of 1–5 mm thickness has been found satisfactory.

The present composite roll comprises, after machining to final shape and dimension, a complete roll or roll ring. Thus, the difficulties with existing cast-in rolls getting a heat treatment furnace with the necessary dimensions, and the costs and loss of time that this heat treatment generates are eliminated by using the cast alloy according to the invention.

The invention is now described with reference to the following non-limiting example which is intended to illustrate a cast iron composition and method of manufacturing a composite roll in accordance with the invention.

EXAMPLE

A composite roll was manufactured as follows. First, a sintered cemented carbide ring with the composition, in weight percent, 70% WC, 13% Co, 15% Ni and 2% Cr was molded in foundry sand. The dimensions of the cemented carbide ring were:

Outer diameter: 340 mm

Inner diameter: 260 mm

Width: 100 mm

After molding the cemented carbide ring, the inner surface of the cemented carbide ring and its side surfaces between the inner and outer diameters were placed in contact with molten cast iron to create a metallurgical bond between the cemented carbide and the cast iron.

The composite roll was cast by static casting in a mould where the inlet is directed in a tangential direction to the inner surface of the cemented carbide roll ring. A cast iron melt, with the composition, in weight, 3.5% C, 2.2% Si, 0.6% Mn, 1.65% Ni, 0.05% Mg and the balance Fe, at a temperature of 1540° C. was poured into the mould. The duration of the pouring was about 1 minute.

After cooling the, composite roll, the composite roll was cleaned and checked by an ultrasonic method. The quality of the metallurgical bond was good.

The roll dimensions were:

Barrel: Ø310 mm (cemented carbide Ø340 mm)×500 mm.

Journals: Ø220×300 mm+Ø220×520 mm.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of manufacturing an as-cast composite roll, comprising:

metallurgically bonding at least one cemented carbide ring to a cast iron casing, the cast iron comprising an essentially graphitic cast iron comprising, in weight %, 1.9–2.8% Si, 0.02–0.10% Mg, 0.5–4% Ni, 0.1–1% Mn, balance Fe, and the cast iron having a $C_{eqv}$=2.5–6 and containing at least 40 volume % pearlite.

2. The method of claim 1, wherein the cast iron comprises 2.1–2.5% Si, 0.04–0.07% Mg, 1–2% Ni, 0.6–0.7% Mn, and the $C_{eqv}$=3.5–5.

3. The method of claim 1, wherein the cast iron is cast such that an outer periphery of the cemented carbide ring is exposed, opposed sides and an inner periphery of the cemented carbide ring are in contact with the cast iron and an outer periphery of the cemented carbide ring is exposed.

4. The method of claim 3, wherein the cemented carbide ring is placed in a mould, the cast iron is melted to form molten cast iron and the mould is at least partially filled with the molten cast iron.

5. The method of claim 4, wherein the molten cast iron is directed in a tangential direction to the inner periphery of the cemented carbide ring.

6. The method of claim 4, wherein the mould is rotated and the molten cast iron is cast by centrifugal casting.

7. The method of claim 1, wherein the cemented carbide ring is cast in contact with the cast iron casing, and a core and journals of a cast alloy different than the cast iron are cast in a bore within the cast iron casing.

8. The method of claim 1, wherein the cast iron is poured at a temperature of at least 1500° C. into contact with the cemented carbide ring, the composite roll being formed without heat treatment after the metallurgical bonding is completed.

9. The method of claim 1, wherein a transition zone forming a metallurgical bond between the cemented carbide ring and the cast iron has a thickness of 1 to 5 mm.

* * * * *